US009668579B2

(12) United States Patent
Johnson

(10) Patent No.: US 9,668,579 B2
(45) Date of Patent: Jun. 6, 2017

(54) RECLINING CHAIR

(71) Applicant: Sauder Manufacturing Co., Archbold, OH (US)

(72) Inventor: Timothy J. Johnson, Archbold, OH (US)

(73) Assignee: Sauder Manufacturing Co., Archbold, OH (US)

( * ) Notice: Subject to any disclaimer, the term of this patent is extended or adjusted under 35 U.S.C. 154(b) by 109 days.

(21) Appl. No.: 14/731,809

(22) Filed: Jun. 5, 2015

(65) Prior Publication Data

US 2016/0353890 A1 Dec. 8, 2016

(51) Int. Cl.
*A47C 1/02* (2006.01)
*A47C 1/0355* (2013.01)

(52) U.S. Cl.
CPC ..... *A47C 1/0355* (2013.01)

(58) Field of Classification Search
CPC ..... A47C 1/0355; A47C 1/035
USPC ..... 297/85 L, 83, 84
See application file for complete search history.

(56) References Cited

U.S. PATENT DOCUMENTS 3,730,585 A * 5/1973 Rogers, Jr. ..... A47C 3/025 297/259.2
3,904,240 A * 9/1975 Rogers, Jr. ..... A61G 15/02 297/259.2
4,108,491 A * 8/1978 Rogers, Jr. ..... A47C 1/0355 297/322
4,696,512 A * 9/1987 Burnett ..... A47C 1/035 297/330
4,989,914 A * 2/1991 Pine ..... A47C 1/0355 297/232
5,141,284 A * 8/1992 LaPointe ..... A47C 1/0352 297/325
5,217,276 A * 6/1993 LaPointe ..... A47C 1/0355 297/68
5,704,686 A * 1/1998 May ..... A47C 1/0355 297/273
5,800,010 A * 9/1998 May ..... A47C 1/0355 297/84
5,865,457 A * 2/1999 Knabusch ..... A61G 5/006 280/304.1
6,089,593 A * 7/2000 Hanson ..... A61G 5/006 280/250.1
6,095,610 A * 8/2000 Okajima ..... B60N 2/4495 297/423.2
6,402,232 B1 * 6/2002 Tsai ..... A47C 1/0342 297/68
6,604,791 B1 * 8/2003 Chen ..... A47C 1/035 297/300.1
6,634,706 B2 * 10/2003 May ..... A47C 1/0355 297/270.1
6,692,078 B2 * 2/2004 Pham ..... A47C 1/0342 297/423.19

(Continued)

*Primary Examiner* — David R Dunn
*Assistant Examiner* — Alexander Harrison
(74) *Attorney, Agent, or Firm* — McGarry Bair PC

(57) ABSTRACT

A reclining chair includes a stationary frame having first and second sides, a seat, a seat back, and a foot rest mounted to the frame, a linkage mechanism mounted to the frame and configured to move the seat, the seat back, and the foot rest between a sitting position and a reclining position and having a driving arm adjacent to the first side and configured to drive the linkage mechanism, and a rotatable arm mounted to the first side of the stationary frame.

11 Claims, 3 Drawing Sheets

(56) References Cited

U.S. PATENT DOCUMENTS

| | | | | |
|---|---|---|---|---|
| 6,726,279 | B1 * | 4/2004 | Figel | A61G 5/006 297/340 |
| 6,945,599 | B2 * | 9/2005 | May | A47C 3/027 297/270.1 |
| 6,974,186 | B1 * | 12/2005 | Chang | A47C 1/035 297/423.19 |
| 7,040,692 | B1 * | 5/2006 | Pine | A47C 1/0355 297/270.2 |
| 7,431,387 | B2 * | 10/2008 | LaPointe | A47C 1/0345 297/303.4 |
| 8,177,296 | B2 * | 5/2012 | Shih | A47C 1/0345 297/260.2 |
| 8,696,054 | B2 * | 4/2014 | Crum | A47C 1/0355 297/83 |
| 8,882,190 | B2 * | 11/2014 | Garland | A47C 7/506 297/85 L |
| 2005/0258670 | A1 * | 11/2005 | LaPointe | B60N 2/4495 297/85 L |
| 2007/0241589 | A1 * | 10/2007 | LaPointe | A47C 1/0355 297/85 L |
| 2012/0112518 | A1 * | 5/2012 | Murphy | A47C 1/0355 297/85 L |
| 2014/0097647 | A1 * | 4/2014 | Grace | A47C 3/0255 297/42 |
| 2015/0282619 | A1 * | 10/2015 | Lawson | A47C 1/0355 297/83 |

* cited by examiner

RECLINING CHAIR

BACKGROUND OF THE INVENTION

Articles of furniture can be configured to transform into different positions based on user preferences. For example, a reclining chair can include a seat back, foot rest, and internal linkage mechanisms to provide a chair that can include a sitting position, wherein the seat back is upright and the foot rest is not extended from the chair, and a reclining position, wherein the seat back is reclined and the foot rest is extended from the chair to provide elevated support to the user's legs or feet. The transforming between the sitting position and the reclining position can be user-controllable by way of a user input device, such as a lever. As the user input device controls the transformation between the chair positions, the linkage mechanisms can be configured to move internally and relative to the user input device. A transmission linkage can be configured to couple the user input device with the internal linkage mechanisms of the article of furniture to transfer the user input to a linkage mechanism that moves relative to the user input device. Where the motion is more complex, such as in a health care facility where the seat also slides as extension occurs, the prior art includes a lever that moves with the seat to accommodate the more complex motion. Such accommodations compromise the appearance of the chair.

BRIEF DESCRIPTION OF THE INVENTION

In one aspect, a reclining chair includes a stationary frame having first and second sides, a seat, a seat back, and a foot rest mounted to the frame, a linkage mechanism mounted to the frame and configured to move the seat, the seat back, and the foot rest between a sitting position and a reclining position and having a driving arm adjacent to the first side and configured to drive the linkage mechanism, a rotatable arm mounted to the first side of the stationary frame, and a transmission linkage coupled to the driving arm and the rotatable arm. The transmission linkage further includes at least two universal joints and a telescoping joint.

DESCRIPTION OF EMBODIMENTS OF THE INVENTION

Embodiments of the invention may be implemented in any environment wherein a unit, such as a box, container, bin, or article of furniture is configured to transform between a first position and a second position. While "position" is described, any article of furniture that can include transforming motions, operating states, or modes are envisioned. Embodiments of the disclosure can include any article of furniture suitable for transformation from a first position to a second position in a residential, industrial, or medical setting. Moreover, the article of furniture can be configured for supporting the body of a user, or for supporting non-human masses, such as cargo, animals, crates, and the like.

Figure 1:
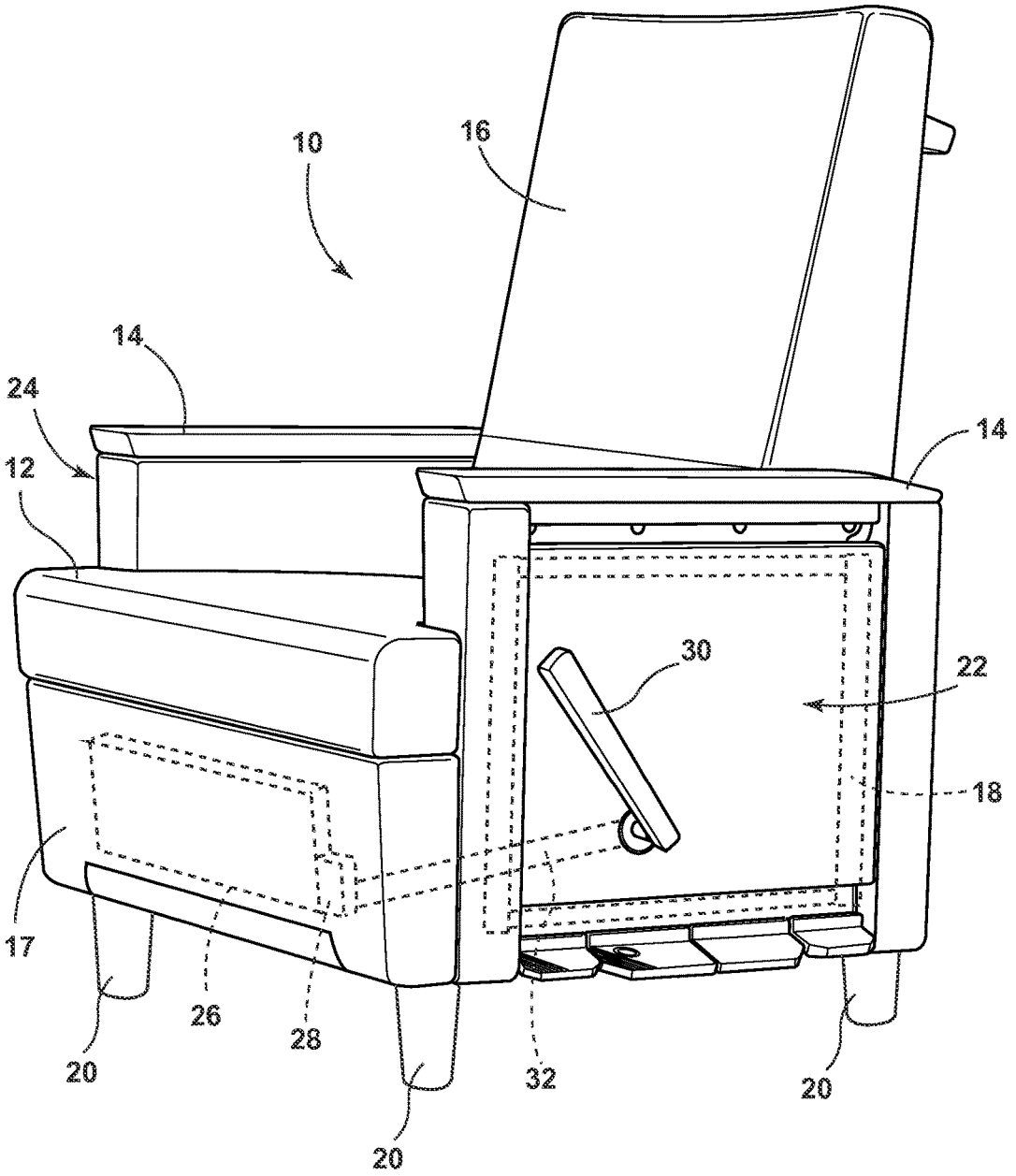
FIG. 1 is a perspective view of an article of furniture, shown as a chair.

Turning to FIG. 1, an article of furniture 10, shown as a reclining chair, comprises general chair components including a seat 12, arms 14, a seat back 16, and a foot rest 17. The article of furniture 10 can further include a stationary frame 18, internal or external to the furniture 10, and illustrated in dotted line. The stationary frame 18 supports or mounts with the seat, 12, arms 14, seat back 16 and foot rest 17, and can further support the furniture 10 relative to the ground, for example, by way of chair legs 20. The stationary frame 18 can include or define a first side 22 of the furniture 10, including one arm 14, and an opposing second side 24 of the furniture 10, including the opposing arm 14. As used herein, the frame 18 is "stationary" in the sense that the frame does not move, transform, transition, or the like, relative to the article of furniture 10 or other components, such as the seat 12, arms 14, seat back 16, or foot rest 17. While the stationary frame 18 is only illustrated on the first side 22, embodiments of the disclosure are envisioned wherein the stationary frame 18 extends throughout the article of furniture 10 to provide structure, as described herein, and is only illustrated on the first side 22 for ease of understanding and brevity. Additionally, while chair legs 20 are illustrated, embodiments of the disclosure are equally applicable in any article of furniture 10 having supporting elements, including but not limited to, legs, casters, wheels, or mounting elements configured to couple with a floor. Additional supporting elements are envisioned.

The article of furniture 10 can be further configured to transform into different positions based on user preferences. For example, the furniture 10 can include a reclining chair having an internal linkage mechanism 26 (schematically illustrated in dotted line) mounted to the stationary frame 18, and having a driving arm 28 (also shown schematically in dotted line) configured to drive the linkage mechanism 26. In this sense, the internal linkage mechanism 26 may be in a mechanical relationship with the driving arm 28 such that movement, motion, or input from the driving arm 28, such as a rotation of the driving arm 28, generates a corresponding transformation of the internal linkage mechanism 26.

The internal linkage mechanism 26 can be configured to position the article of furniture 10 in a first position, such as a chair in a sitting position, and a second position, such as chair in a reclining position. In the provided example, the sitting position (illustrated in FIG. 1) can include positioning the described components such that the seat back 16 is upright and the foot rest 17 is not extended from the base of the chair, while the reclining position can including positioning, for example, the seat back 16 in a reclined, or slightly more horizontal position compared to the upright position, and the foot rest 17 is extended from the chair to provide elevated support, for example, a user's legs or feet. An example of the reclined position can be seen in FIG. 2, described below.

The transformation of the article of furniture 10 between the sitting position and the reclining position can be further controllable by way of an input device, illustrated rotatable arm 30 or rotatable lever that can be mounted adjacent to at least one side of the stationary frame 18, shown in FIG. 1 as the first side 22. The rotatable arm 30 may be configured to include, for example, a pivot point-type mounting configuration with the first side 22. In this configuration, both the rotatable arm 30 and the driving arm 28 are proximate to, or adjacent to, the same side of the article of furniture 10. The rotatable arm 30 can be mechanically coupled or connected with the driving arm 28 of the linkage mechanism 26 by way of a transmission linkage 32 coupled with each of the rotatable arm 30 and the driving arm 28. For example, at least a partial rotation of the rotatable arm 30 can be mechanically translated by way of the transmission linkage 32 to the driving arm 28, which in turn, controls the transformation of the article of furniture 10 between the sitting position and the reclining position, as described herein.

While rotational movement of the rotatable arm 30, transmission linkage 32, and driving arm 28 have been described, alternative mechanical or electro-mechanical movement between a user providing a user input, the transmission linkage 32, and the driving arm 28, are envisioned. For example, embodiments of the disclosure can include an article of furniture 10 wherein a controllable electronic signal, such as a button press or the like, generates mechanical or electro-mechanical movement or motion to transform the article of furniture 10 between the first position and the second position. Additionally, it is understood that different mechanical motions can be utilized to provide the movement or motion for transforming the article of furniture 10 between the first position and the second position, such as leaning the seat back 16 to a reclined position (by way of a, for example, a gear transmission linkage 32). Additional movements and motions are envisioned.

Embodiments of the disclosure are envisioned wherein, for example, the transmission linkage 32 is mounted with each of the rotatable arm 30 and the driving arm 28 at opposing ends. In another example embodiment, at least one of the rotatable arm 30 or the driving arm 28 can further include a sleeve-type mounting configuration and the transmission linkage 32 can include a male arm configured to be received by the sleeve-type mounting of the respective at least one rotatable arm 30 or driving arm 28. Additionally, the transmission linkage 32 can be fixedly or selectively coupled with at least one of the rotatable arm 30 or driving arm 28.

Figure 2:
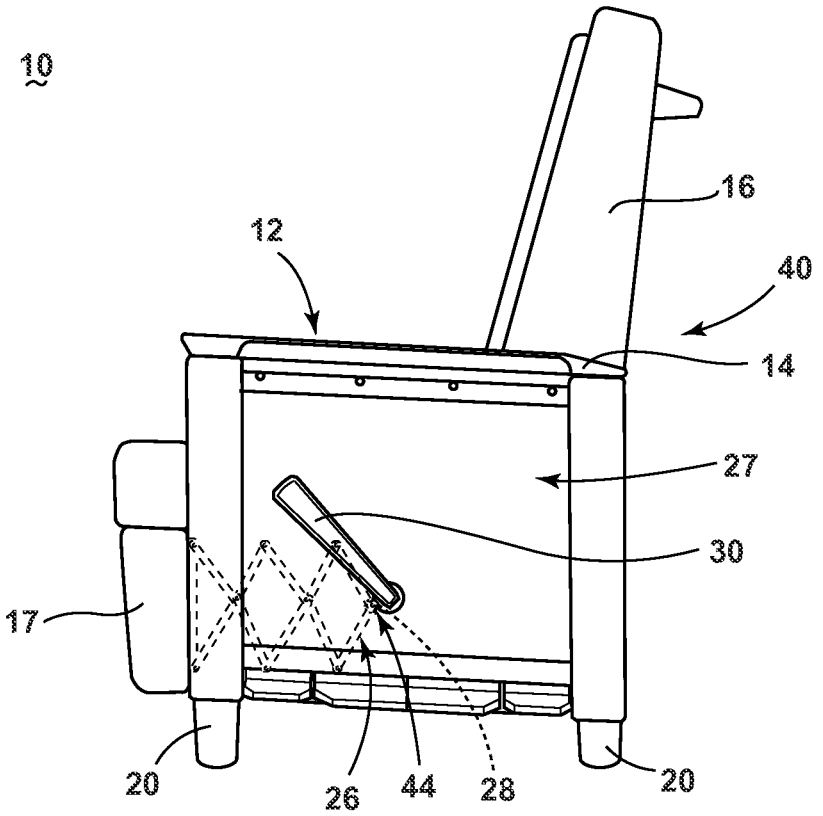
FIG. 2 is a profile view of the chair of FIG. 1, illustrating the chair in a sitting position and a reclining position.
Figure 2:
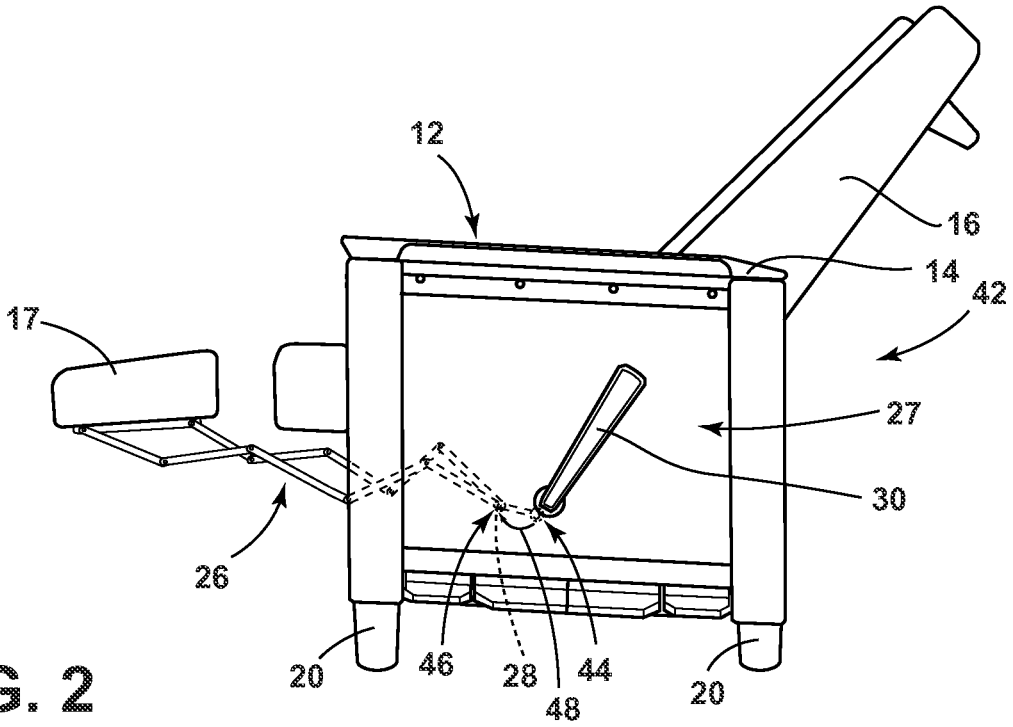

FIG. 2 illustrates a side view of the article of furniture 10 showing the difference between the sitting position 40 and the reclining position 42. The transmission linkage 32 is not shown in the illustrations for the sitting position 40 nor the reclining position 42, for ease of understanding the movement or location of the driving arm 28 or the linkage mechanism 26. As shown in the sitting position 40, the rotatable arm 30 is in a first position corresponding with the sitting position 40. While configured in the sitting position 40, the seat back 16 is upright and the foot rest 17 is not extended from the base of the article of furniture 10. As explained herein, the seat back 16 and foot rest 17 can be controllable by the linkage mechanism 26, illustrated in dotted line, internal to the article of furniture 10, which is controllable by the driving arm 28, shown in a first location 44 relative to the article of furniture 10, seat 12, or stationary frame 18 (not shown).

As shown in the reclining position 42, the rotatable arm 30 is in a second position corresponding with the reclining position 42. While configured in the reclining position 42, the seat back 16 is reclined and the foot rest 17 is extended from the base of the article of furniture 10. As explained herein, the linkage mechanism 26 is activated, operated, or transformed by the driving arm 28, which has been activated, moved, or rotated due to the mechanical coupling with the rotatable arm 30, which as previously explained, has been positioned corresponding with the reclining position 42. Stated another way, the movement of the rotatable arm 30 is translated (by way of the transmission linkage 32, not shown) to movement of the driving arm 28, which operates to extend the linkage mechanism 26, transforming the article of furniture 10 into the reclining position 42. While configured in the reclining position 42, the driving arm 28 is in a second location 46, different from the first location 44.

During the transformation from the sitting position 40 to the reclining position 42, the driving arm 28 is configured to transition between the first location 44 and the second location 46 in a non-linear motion (illustrated by arrow 48), relative to the article of furniture 10, seat 12, or stationary frame 18. Since the driving arm 28 is configured to transition between the first location 44 and the second location 46 in a non-linear motion 48 while mechanical coupled with the rotatable arm 30 fixed about a pivotable base, a conventional fixed-length transmission linkage 32 will be inappropriate to compensate for the length variance between the rotatable arm 30 and the driving arm 28 in the respective sitting and reclining positions 40, 42, while also translating the mechanical movement (e.g. rotation) of the rotatable arm 30 to the driving arm 28.

Figure 3:
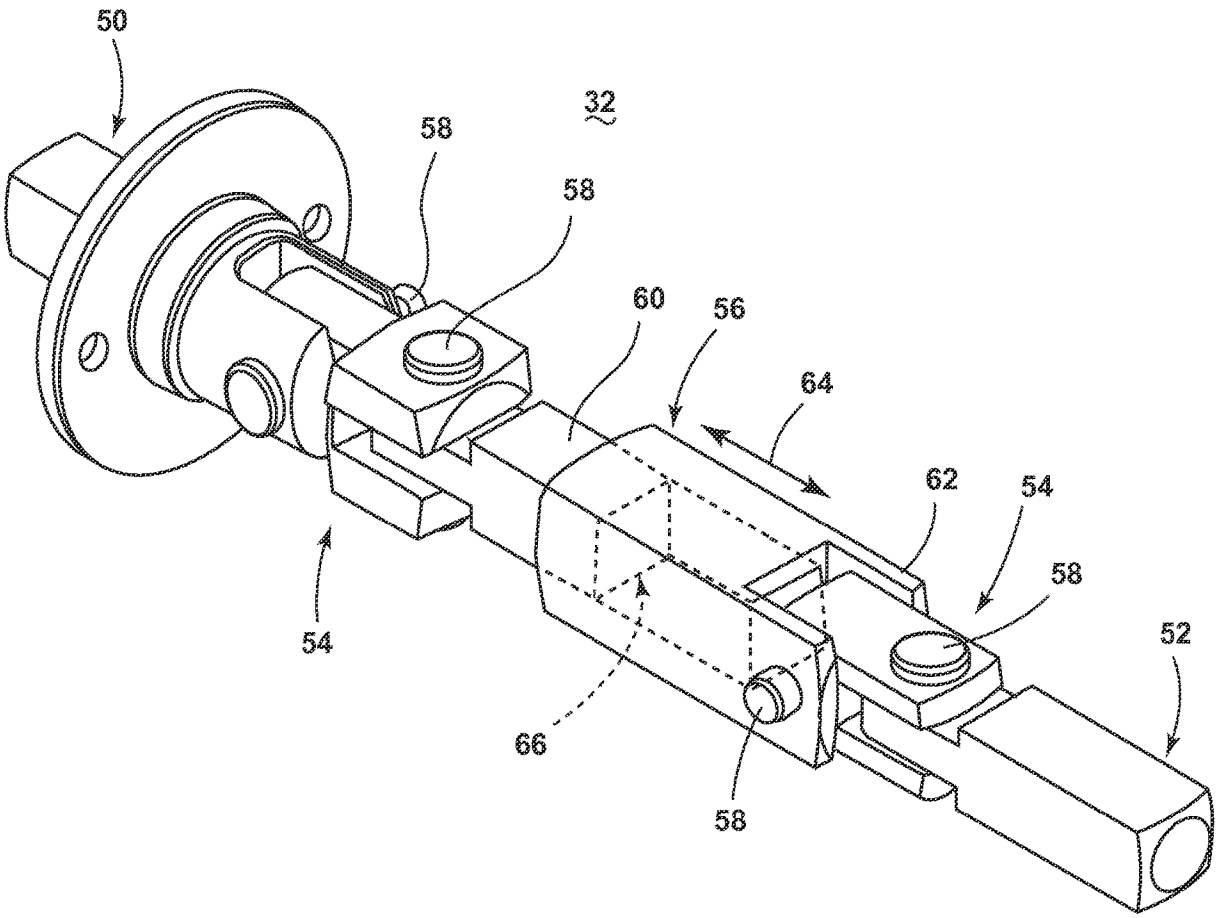
FIG. 3 is a perspective view of a transmission linkage for the chair of FIG. 1

FIG. 3 illustrates one exemplary embodiment of a transmission linkage 32 according to the disclosure. As illustrated the transmission linkage can include a first end 50 configured to mechanically couple with the rotatable arm 30, an opposing second end 52 configured to mechanically couple with the driving arm 28, at least two universal joints 54 and a telescoping joint 56. Each universal joint 54 can include one or more sub joints 58, for example hinges, and is configured to allow movement, such as rotation, to be translated, carried, or delivered from the first end 50 of the transmission linkage 32 to the second end 52, even when the second end 52 is not aligned with the axis of rotation of the first end 50. In this sense, the transmission linkage 32 will carry, convey, translate, or transfer a source of rotation coupled with the first end 50, such as the rotatable arm 30, with a destination of the rotation coupled with the second end 52, such as the driving arm 28, regardless of if the rotatable arm 30 and driving arm 28 are axially aligned.

Additionally, the telescoping joint 56 can include a first arm 60 received by a second arm 62 and configured such that the first arm 60 is free to move telescopically (shown by arrows 64) within the second arm 62. In this sense, the length of the transmission linkage 32 can vary according to the telescopic movement 64 of the first arm 60 within the second arm 62. Each of the first arm 60 and second arm 62 can be further keyed or configured to prevent rotation relative to each other, that is, such that the two arms 60, 62 can only rotate in unison. For example, as shown, each arm 60, 62, or the telescoping joint 56 can be configured to include corresponding square cross sections 66 such that the first arm 60 cannot rotate without a corresponding rotation of the second arm 62.

The telescopic movement 64 of the transmission linkage 32 can accommodate the varying length mechanical coupling between the fixed rotatable arm 30 and the driving arm 28 extending or moving between the first location 44 and the second location 46. Additionally, the keyed configuration of the first arm 60 and second arm 62 allow the rotational movement of the transmission linkage 32 to be carried from the first end 50 to the second end 52 regardless of the telescopic movement 64.

While not shown, the telescoping joint 56, first arm 60, or second arm 62 can be configured with one or more stopping components to prevent overextension or "pulling out" of the first arm 60 from the second arm 62. In this sense, the one or more stopping components can be configured to provide a maximum extendable length of the transmission linkage 32, which for example, can be greater than the maximum length variance between the rotatable arm 30 and the driving arm 28 in the first or second locations 44, 46. Likewise, the telescoping joint 56, first arm 60, or second arm 62 can be configured such that the first arm 60 is received within the second arm 62 such that the minimum length of the transmission linkage 32 is less than the minimal length variance between the rotatable arm 30 and the driving arm 28 in the first or second locations 44, 46.

Many other possible embodiments and configurations in addition to that shown in the above figures are contemplated by the present disclosure. For example, one non-limiting embodiment of the disclosure contemplates a universal joint 54 including one or more ball bearing joints that are keyed to prevent independent rotation between the first end 50 and the second end 52 of the transmission linkage 32. Additional universal joints 54 allowing for partial or full universal movement between the first end 50 and second end 52, but wherein the first end 50 and second end 52 are rotationally coupled, are envisioned. Furthermore, while corresponding square cross sections 66 of the first arm 60 and second arm 62 are illustrated, it will be appreciated that any number of regular or irregular geometric shapes are contemplated to prevent rotation relative to each arm 60, 62.

Additionally, while the telescoping joint 56 has been shown located between the universal joints 54, embodiments of the disclosure are envisioned wherein the in-line configuration of the transmission linkage 32 is altered, such as wherein the telescoping joint 56 is positioned at the first end 50 or the second end 52 (e.g. outside of the universal joints 54), or wherein the telescoping joint 56 is partially or wholly included with, incorporated in, or located at the rotatable arm 30 or driving arm 28. For example, one non-limiting example configuration can include the telescoping joint 56 located at or include as a portion of the sleeve at the driving arm 28.

Furthermore, while a particular example of the linkage mechanism 26 is illustrated in the sitting position 40 and the reclining position 42, the linking mechanism 26 itself is germane to the disclosure, and alternative linkage mechanisms 26 are envisioned, so long as they are driven or operated by a driving arm 28 as explained herein. Additionally, the design and placement of the various components may be rearranged such that a number of different in-line configurations could be realized. For example, while the rotatable arm is shown on the first side 22 of the article of furniture 10, it will be understood that alternative configurations can include a rotatable arm 30 configured on the second side 24 of the furniture 10. In yet another configuration, the rotational movement of the rotatable arm 30 relative to at least one of the transmission linkage 32 or driving arm 28 can include a gearbox configured to generate more or less resulting rotation at the driving arm 28, as needed to transform the article of furniture from the sitting position 40 to the reclining position 42. Moreover, FIG. 2 illustrates merely one non-limiting first position for the rotatable arm 30 corresponding with the sitting position 40 and one non-limiting second position for the rotatable arm 30 corresponding with the reclining position 42. Additional first and second positions are envisioned, for example, having a greater or lesser degree of rotation between the positions, or having a different starting or ending position, or even having a configuration to allow the rotatable arm 30 to rotate in either a clockwise or counter-clockwise rotation.

Additionally, embodiments of the disclosure are envisioned wherein the article of furniture 10 includes additional movements of the seat 12, the seat back 16, and the foot rest 17 beyond the aforementioned sitting and reclining positions 40, 42. For example, articles of furniture 10 can include a third chair position, such as a sleeping position or configuration of the chair corresponding with a third position of the rotatable arm 30, or even a fourth chair position, such as a Trendelenburg position, corresponding with a fourth position of the rotatable arm 30. Additional configurations or combinations of chair positions can be included.

The embodiments disclosed herein provide a reclining chair having a transmission linkage configured to adjust in length while providing a movement, motion, or rotation between a rotatable arm and a linkage mechanism that toggles the reclining chair between a sitting position and a reclining position. One advantage that may be realized in the above embodiments is that the above described embodiments are configured to provide a user with a fixed pivot point for rotating the rotatable arm, while providing a linkage mechanism having a movable driving arm. Thus, a user can operate the rotatable arm about the fixed point, an operation which users are familiar with, while providing the flexibility to design and/or implement a linkage mechanism having a movable driving arm, internal to the article of furniture. In this sense, a user can operate a reclining chair in a method of lever movement very familiar while accounting for a new, different, or variable internal mechanism for transforming the chair from a sitting to a reclining position, and vice versa.

The new, different, or variable internal mechanism can be designed to include benefits over conventional reclining chair internal mechanisms, such as smoother or improved reclining or sitting performance, improved performance in transitioning between the sitting and reclining positions, or operation requiring less force or effort by a user. Less force or effort by a user can be particularly important in furniture environments for weakened or less-able users, such as in a medical or hospital setting, or a retirement home. Additional environments are envisioned. The new, different, or variable internal mechanisms can otherwise have required a movable driving arm, as described herein, which may have necessitated a different rotatable arm or transmission linkage, and thus, an unfamiliar part, method, or movement of the rotatable arm for the user. The current disclosure improves the design by accounting for the new or different movements while providing the user the familiar operation.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A reclining chair comprising:

a stationary frame having first and second sides;

a seat, a seat back, and a foot rest mounted to the frame;

a linkage mechanism mounted to the frame and configured to move the seat, the seat back, and the foot rest between a sitting position and a reclining position and having a driving arm adjacent to the first side and configured to drive the linkage mechanism by rotational and translational motion between a first location and a second location relative to the stationary frame;

a rotatable arm mounted to the first side of the stationary frame for rotational motion about a pivot axis; and a transmission linkage on the first side having a first end coupled to the rotatable arm and a second end coupled to the driving arm;

wherein the transmission linkage comprises at least two universal joints and a telescoping joint to maintain the coupling to the rotatable arm and to the driving arm as the driving arm translates and rotates.

2. The reclining chair of claim 1 wherein the first location of the driving arm is when the seat, the seat back, and the foot rest are in the sitting position and the second location of the driving arm is when the seat, the seat back, and the foot rest are in the reclining position.

3. The reclining chair of claim 2 wherein the translational motion of the driving arm is non-linear.

4. The reclining chair of claim 1 wherein the telescoping joint is located between the universal joints.

5. The reclining chair of claim 4 wherein the telescoping joint further comprises a first arm received by a second arm and wherein the first arm is configured to move telescopically within the second arm.

6. The reclining chair of claim 5 wherein the first and second arms are keyed to prevent rotation relative to each other.

7. The reclining chair of claim 6 wherein the first and second arms comprise corresponding square cross sections.

8. The reclining chair of claim 1 wherein the rotatable arm is mounted to the first side of the stationary frame at the pivot point.

9. The reclining chair of claim 8 wherein the rotatable arm is configured to be rotatable between a first position corresponding with the sitting position and a second position corresponding with the reclining position.

10. The reclining chair of claim 1, wherein the rotatable arm is a lever.

11. The reclining chair of claim 8 wherein telescoping joint is between the universal joints.

* * * * *